US005763859A

United States Patent [19]

Wirz et al.

[11] Patent Number: 5,763,859

[45] Date of Patent: Jun. 9, 1998

[54] INDUCTION HEATING DRAW ROLLER WITH VIBRATION DAMPING

[75] Inventors: Armin Wirz, Ossingen; Kurt Wetter, Hagenbuch, both of Switzerland

[73] Assignee: Maschinenfabrik Rieter AG, Winterthur, Switzerland

[21] Appl. No.: 379,548

[22] PCT Filed: Jun. 2, 1994

[86] PCT No.: PCT/CH94/00104

§ 371 Date: Mar. 10, 1995

§ 102(e) Date: Mar. 10, 1995

[87] PCT Pub. No.: WO94/29500

PCT Pub. Date: Dec. 22, 1994

[30] Foreign Application Priority Data

Jun. 4, 1993 [CH] Switzerland ..... 1680/93
Mar. 28, 1994 [CH] Switzerland ..... 925/94

[51] Int. Cl.[6] ..... H05B 6/14

[52] U.S. Cl. ..... 219/619; 219/652; 219/469; 492/46; 492/15; 226/194

[58] Field of Search ..... 219/619, 650, 219/652, 469, 470, 471; 492/46, 15; 100/93 RP; 226/190, 194

[56] References Cited

U.S. PATENT DOCUMENTS

| | | | |
|---|---|---|---|
| 3,601,968 | 8/1971 | Wirz . | |
| 3,701,873 | 10/1972 | Bauer et al. . | |
| 4,055,220 | 10/1977 | Stelwagen . | |
| 4,180,717 | 12/1979 | Lenk et al. . | |
| 4,196,796 | 4/1980 | Kanamaru | 188/134 |
| 4,304,975 | 12/1981 | Lenk et al. . | |
| 4,342,488 | 8/1982 | Anderson et al. | 308/15 |
| 4,666,317 | 5/1987 | Holthoff | 384/447 |
| 4,884,666 | 12/1989 | Stahl | 188/378 |
| 4,910,842 | 3/1990 | Brendel | 29/110 |
| 5,159,166 | 10/1992 | Arnosti et al. . | |
| 5,254,070 | 10/1993 | Callhoff . | |

FOREIGN PATENT DOCUMENTS

| | | |
|---|---|---|
| 0349829 | 1/1990 | European Pat. Off. . |
| 0454618 | 10/1991 | European Pat. Off. . |
| 2098131 | 3/1972 | France . |
| 1953692 | 5/1970 | Germany . |
| 1962430 | 7/1970 | Germany . |
| 2039213 | 2/1971 | Germany . |
| 1948525 | 4/1971 | Germany . |
| 2647540 | 2/1978 | Germany . |
| 4107719 | 9/1992 | Germany . |
| 1269737 | 4/1972 | United Kingdom . |
| 1319318 | 6/1973 | United Kingdom . |

*Primary Examiner*—Philip H. Leung
*Attorney, Agent, or Firm*—Greenblum & Bernstein, P.L.C.

[57] ABSTRACT

In order to prevent transmitting vibrations which are generated by the turning of a godet to an inductor used for heating the godet, the inductor may be arranged vibration-free on bearings by a vibration damper. The vibration damper may be arranged between a carrying cylinder flange of a carrying cylinder, which accommodates the inductor, and a housing end wall. A further vibration damper ring may be provided between a centering ring, for the radial damping of the inductor, with the carrying cylinder flange being pressed against the vibration damper by screws and a pressure spring being provided between the screw and the carrying cylinder flange for pressing against the carrying cylinder flange.

30 Claims, 6 Drawing Sheets

INDUCTION HEATING DRAW ROLLER WITH VIBRATION DAMPING

CROSS REFERENCE TO RELATED APPLICATIONS

This application claims the priority of PCT Application No. PCT/CH94/00104, filed Jun. 2, 1994, which in turn claims the priority of Swiss Application No. 1680/93-4, filed Jun. 4, 1993, and Swiss Application No. 925/94-0, filed Mar. 28, 1994, the disclosures of which are incorporated herein by reference in their entireties.

BACKGROUND OF THE INVENTION

1. Field of the Invention

The invention relates to a draw roller unit for draw winding machines, draw-spinning winding machines and draw twisting machines wherein the draw roller unit includes an inductor for heating a godet, a rotatably journalled drive shaft for journalling the godet, and a housing for both the attachment of a carrying cylinder, with the carrying cylinder carrying the inductor, and for the retention of bearings for the drive shaft.

2. Discussion of the Background of the Invention and Material Information

Such draw roller units are known, e.g., from European patent applications 0 349 829 A2 and 0 454 618 A1, both applications being assigned to the assignee of the present invention.

Such draw roller units have a high operating speed, in order to e.g. convey and heat filament threads with up to 6 000 m/min onto the heated galettes. Here one galette can have a weight of, e.g., 25 kg so that the combination of mass and high speed invariably leads to vibrations which can be transmitted within the draw roller units and cause resonances which may give rise to malfunctions during operation.

Inhibition of such vibrations can take place in various ways, incl. with measures relating to weight and stiffness of the parts vibrating or on the other hand by providing corresponding vibration-damping elements at suited places.

Locating such places is not easy however and requires imagination in the analyzation and the determination of possible vibrations in order to pinpoint possible vibration sources and to essentially inactivate these by placing suited damping means.

As a rule the rotating parts are arranged on dampened bearings so that next to no vibrations are transmitted to the stationary parts, but this may lead to complicated and expensive solutions depending on the construction. Furthermore, stationary parts may also create their own vibrations, e.g., concerning the inductors within the galettes which heat the casing of the galettes.

Therefore, it is the object of this invention to find new ways to inhibit the vibrations at stationary parts which can be triggered by rotating elements or mentioned own vibrations of stationary parts.

SUMMARY OF THE INVENTION

This object is achieved according to the invention by the features specificied in the claims.

Specifically, this invention pertains to a draw roller unit for draw winding machines, draw-spinning winding machines and draw twisting machines with the draw roller unit including an inductor for heating a godet, a rotatably journalled drive shaft for journalling the godet, and a housing for both the attachment of a carrying cylinder, with the carrying cylinder carrying the inductor, and for the retention of bearings for the drive shaft, wherein for the damping of vibrations, created by the operation of the draw roller unit, between the carrying cylinder and the housing, at least one vibration damper and, in combination therewith, at least one radially acting vibration damper is provided between the bearings and the housing.

In a further embodiment of the draw roller unit of this invention, a vibration damper, acting in an axial direction, is provided between the carrying cylinder and the housing.

In another embodiment of the drawing roller unit of this invention, a vibration damper, acting in a radial direction, is provided between the carrying cylinder and the housing.

In a differing embodiment of the draw roller unit of this invention, the vibration damper, provided between the carrying cylinder and the housing, is a combined axially and radially acting vibration damper.

In yet a further embodiment of the draw roller unit of this invention, the axially acting vibration damper is one of a ring-disc shaped damping element and a ring-shaped damping element clamped between the housing and the carrying cylinder.

In yet another embodiment of the draw roller unit of this invention, the radially acting vibration damper comprises a hollow-cylindrical damping element, with the damping element resting, on one side, permanently on an end of a spring pin and on the other side resting, with the outer circumference thereof, in a bore of the housing, with the bore being free from play, wherein another end of the spring pin is permanently embedded in the carrying cylinder, and wherein at least three such damping elements, each in combination with a spring pin, are evenly circumferentially distributed.

In yet a differing embodiment of the draw roller unit of this invention, the radially acting vibration damper is a ring, having an octagonal cross section, connected with the axially acting vibration damper, with the ring of octagonal cross section being placed in conforming, opposed ring-shaped grooves in the housing and in the carrying cylinder.

In still a further embodiment of the draw roller unit of this invention, the radially acting vibration damper takes the form of opposing cylindrical knobs which are located oppositely on both sides of the axially acting vibration damper, with at least three pairs of knobs being evenly circumferentially spaced, and wherein each cylindrical knob is fitted in a bore of a similar diameter, located in the housing and in the carrying cylinder.

In still another embodiment of the draw roller unit of this invention, the radially acting vibration damper comprises a hollow-cylindrical damping element, which on one hand is permanently embedded in a bore in the carrying cylinder, and on the other hand receives one end part of a support pin with the support pin being free from play, and the other end of the support pin being fixedly embedded in the housing, with at least three such damping elements, each in combination with a support pin, being evenly circumferentially spaced.

In still a differing embodiment of the draw roller unit of this invention, the radially acting vibration damper comprises a hollow cylindrical damping element, the damping element being permanently embedded in a bore of the housing, and wherein the damping element receives a spring part, with one end of the spring part being fixedly attached to a support pin which in turn is fixedly embedded in the carrying cylinder, and at another end of the spring part a support pin is fixedly attached, with the support pin being fixedly embedded in the housing, with at least three such damping elements, each in combination with a support pin, being evenly circumferentially distributed.

In an additional embodiment of the draw roller unit of this invention, the radially acting vibration damper comprises two rubber O-rings, the O-rings being clamped, at a mutual distance, between a ring flange of the carrying cylinder and a cylindrical inner surface opposite thereto and wherein a space between the O-rings is filled with one of a fluid and a fully elastic damping element wherein at least three spring pins are fixedly and evenly circumferentially distributed outside of the space in the carrying cylinder and in the housing.

In yet a differing embodiment of the draw roller unit of this invention, the radially acting vibration damper is a slotted sleeve attached free from play on one end of a spring pin with the slotted sleeve being provided with grooves for locating O-rings via which, on one hand, the slotted sleeve is pressed together in a manner to be free from play, and, on the other hand, the O-rings, including the spring pin, are held in a cylindrical cavity of the housing, with another end of the spring pin being fixedly embedded in the carrying cylinder, and wherein the disc-shaped damping element has passage openings for the passage of the spring pin.

In a varying embodiment of the draw roller unit of this invention, a radially acting vibration damper in the form of a slotted sleeve which is attached free from play on one end of a spring pin with the slotted sleeve being provided with grooves for locating O-rings via which, on one hand, the slotted sleeve is pressed together in a manner to be free from play, and, on the other hand, the O-rings, including the spring pin, are held in a cylindrical cavity of the housing, with another end of the spring pin being fixedly embedded in the carrying cylinder, and wherein the disc-shaped damping element has passage openings for the passage of the spring pin, with the radially acting vibration damper being provided for damping the vibrations between the drive shaft and the inductor.

In a further varying embodiment of the draw roller unit of this invention, a radially acting vibration damper, in the form of a hollow cylindrical damping element, with the damping element being permanently embedded in a bore of the housing, and wherein the damping element receives a spring part, with one end of the spring part being fixedly attached to a support pin which in turn is fixedly embedded in the carrying cylinder, and at another end of the spring part a support pin is fixedly attached, with the support pin being fixedly embedded in the housing, with at least three such damping elements, in combination with said support pin, being evenly circumferentially distributed, with the radially acting vibration damper being provided for damping the vibrations between the shaft bearings and the housing.

In another variation of the draw roller unit of this invention, the radially acting vibration damper is provided for the entire damping of the vibrations between the bearings and the housing.

In a differing variation of the draw roller unit of this invention, at least one elastic element is provided between an attachment means for attaching the inductor to the housing and the inductor.

In still a further variation of the draw roller unit of this invention, the elastic element is a pressure spring.

In a final variation of the draw roller unit of this invention, the elastic element is a vibration damper.

The advantage of the invention consists in that it is an effective yet simple solution.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components, wherein.

DETAILED DESCRIPTION OF THE PREFERRED EMBODIMENTS AND BEST MODE

Figure 1:
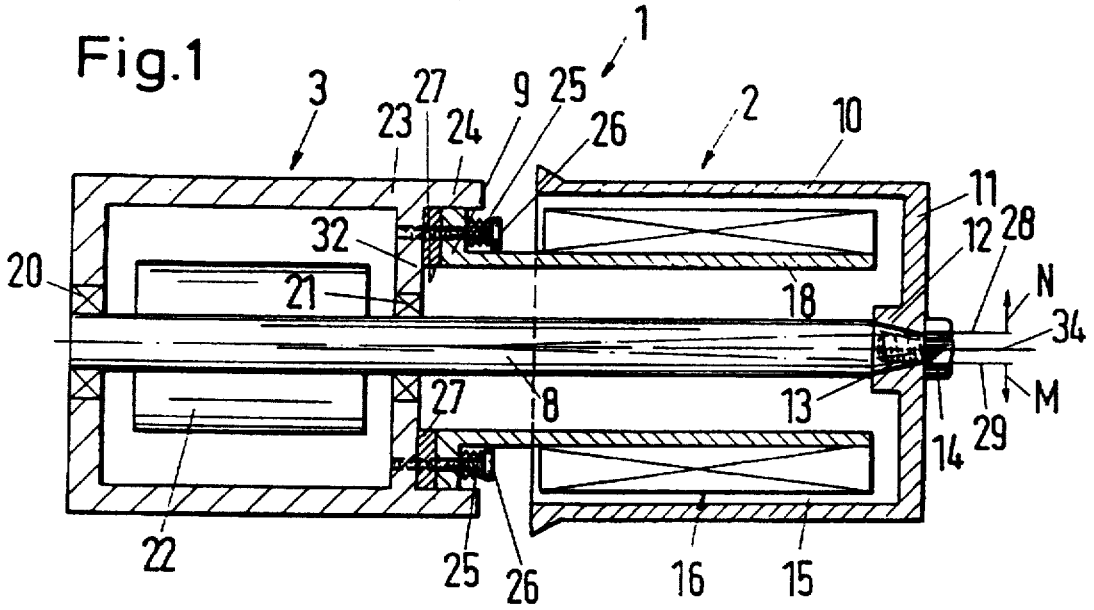
FIG. 1 is a schematic longitudinal section of a draw roller unit in accordance with this invention.

FIG. 1 shows a draw roller unit 1 with a galette or godet 2 and an electric motor 3 with a shaft 8, which shaft is provided with a conical end section 13 to receive a hub 12 at the galette side-end and which is a component of an end wall 11 of the galette 2. The end wall 11 is also connected with a casing 10 onto which the filament (not shown) rests in several loops in the conventional manner during operation.

Inside of the casing 10 and around the shaft 8 an inductor 16 is provided with a clearing or clearance 15 to the casing 10, and which inductor is accommodated on a carrying cylinder 18. In this FIG. 1 deflections of the galette, which are created by radial forces caused by the rotation of the galette and the vibrations caused by it as well as by vibrations caused by the inductor itself, are shown with the arrows marked N and M in a purely schematic manner.

These deflections are to show that during operation the schematically shown symmetric axis 28 with excursion of the inductor 16 must not be coaxial to the also schematically shown rotation axis 29 with counter-excursion of the shaft 8, and which may lead to malfunctions. A coaxial position of these two axes with the geometric axis is shown with the axis 34.

The carrying cylinder 18 has a carrying cylinder flange 9 at the end facing the motor 3 which is centered in radial direction by means of a centering ring 24 pertaining to the motor casing 23.

In axial direction a ring-shaped or a number of ring-shaped arranged vibration dampers are arranged between the carrying cylinder flange 9 and a motor casing end wall 32 in order to prevent that vibrations are transmitted primarily in axial direction from the motor casing 23 to the carrying cylinder 18 and hence to the inductor 16.

Figure 5:
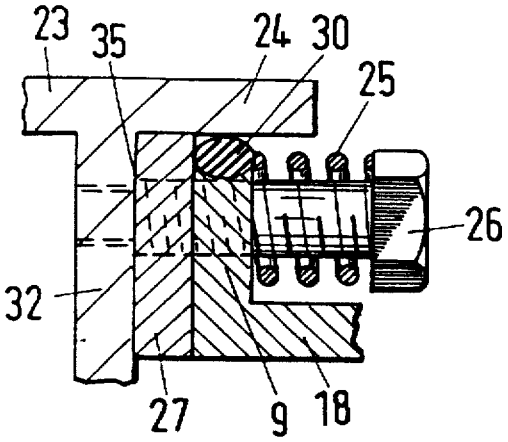
FIG. 5 is an enlarged detail of the draw roller unit of FIGS. 1 and 2.
Figure 6:
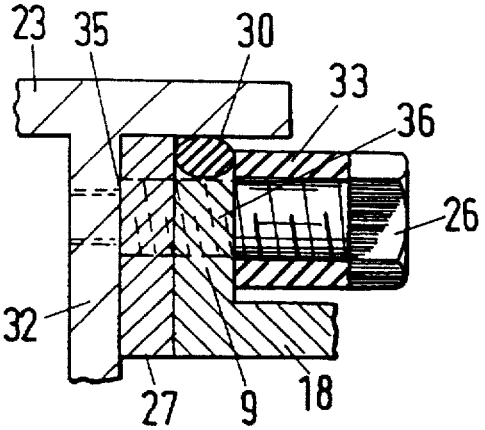
FIG. 6 is a variation of the detail of FIG. 5.

The carrying cylinder flange 9 is pressed towards the motor casing end wall 32 via a pressure spring 25 which is provided between the carrying cylinder flange 9 and a screw 26 and which, when the screw 26 is tightened to a stop 35 shown in FIGS. 5 and 6, exerts a force in axial direction against the carrying cylinder flange 9.

Within the motor casing 23 a rotor 22 is arranged on the shaft 8, which again is rotably held within the motor casing 23 by means of rolling bearings 20 and 21.

With the screw 14 the galette 2 is permanently connected to the shaft 8.

Figure 2:
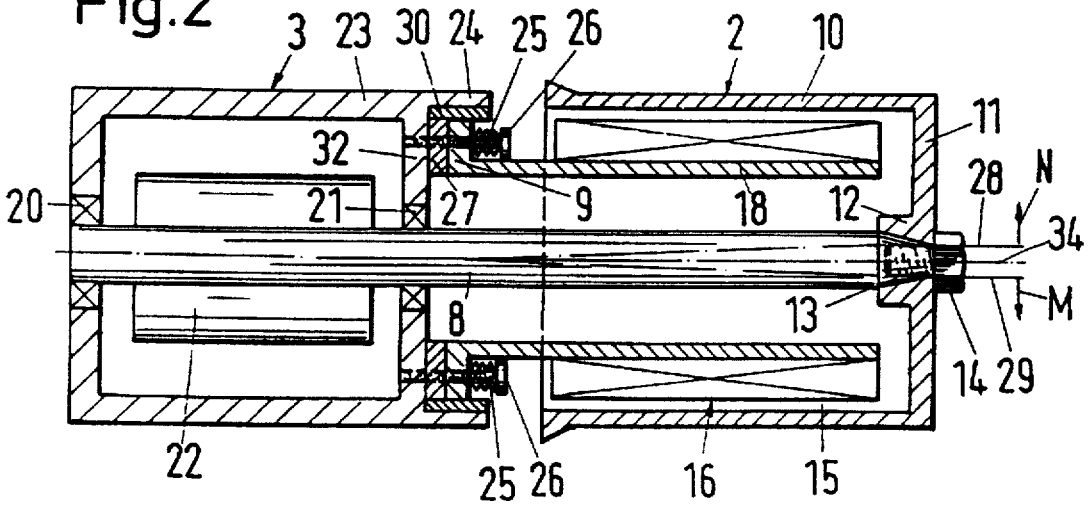
FIG. 2 is a variation of the draw roller unit of FIG. 1.

FIG. 2 shows in comparison to FIG. 1 that between the centering ring 24 and the carrying cylinder flange 9 an additional vibration damping ring 30 is provided, or alternatively a number of ring-shaped arranged vibration dampers are provided, which dampens or which dampen the radially directed vibrations in addition to the axially directed vibration damping by the vibration damper 27.

The other elements correspond to the elements of FIG. 1 and are hence provided with the same reference numbers.

Figure 3:
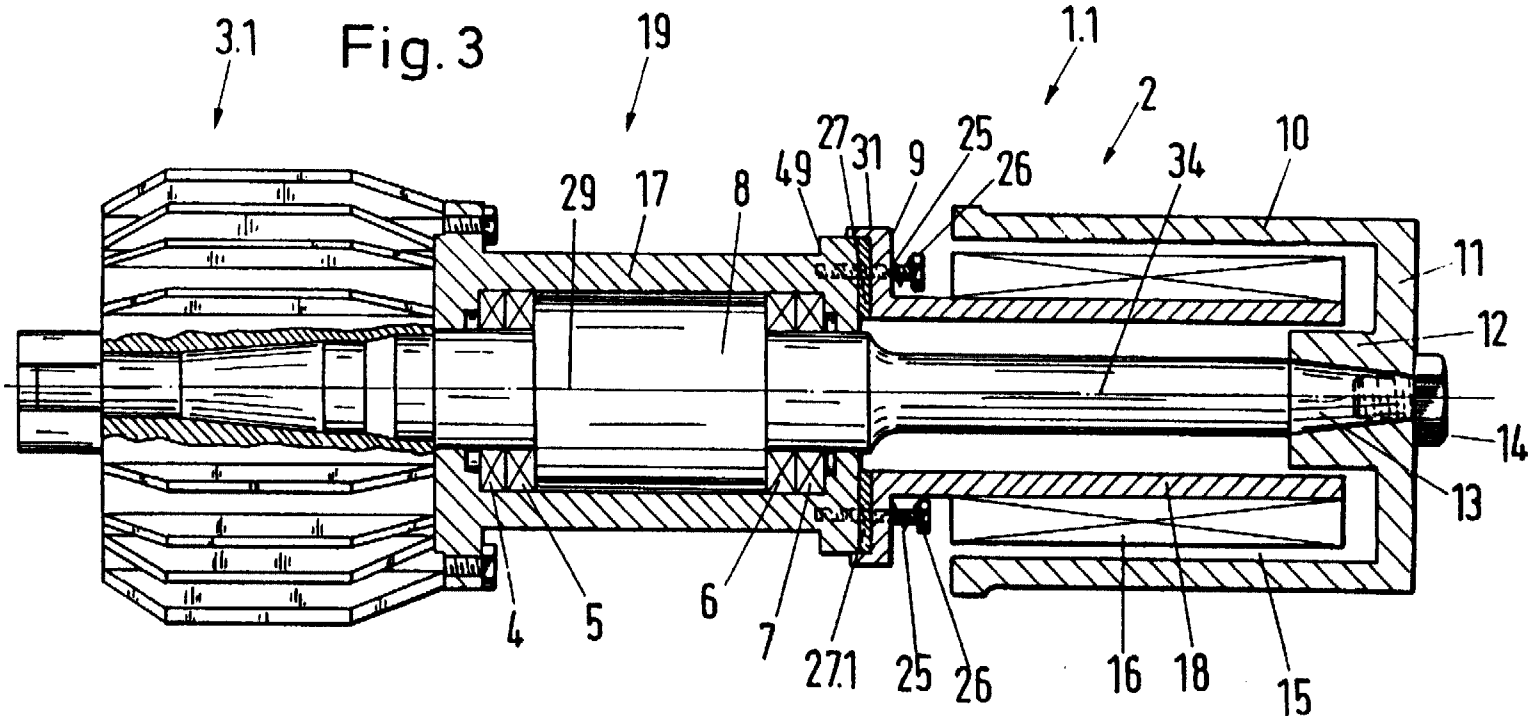
FIG. 3 is a further example of a draw roller unit in accordance with this invention.

FIG. 3 shows a variant of a draw roller unit which is numbered here with 1.1. The same elements which have already been described in connection with FIGS. 1 and 2 or which have the same function have here the same reference number, with the exception that the vibration damper 27 of FIGS. 1 and 2 is numbered here with 27.1 and that the centering of the carrying cylinder flange 9 takes place via a cylinder part 31 which embraces the casing flange 49 and which pertains to the carrying cylinder flange 9.

Furthermore, the motor 3.1 is not arranged immediately next to the galette 2 but attached to a housing 17, in which housing the shaft 8 is rotably held by means of rolling element bearings 4, 5, 6, and 7.

Given that in this variant the deflections via the forces N and M of FIGS. 1 and 2 are not shown, the symmetric axis of the inductor 16 lies coaxial to the rotation axis 29 of the shaft 8, and this is shown by the geometric axis 34.

Figure 4:
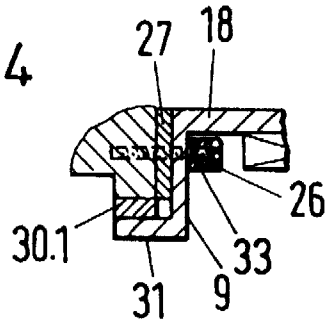
FIG. 4 is a variation of a detail of the draw roller unit of FIG. 3.

FIG. 4 shows a section of FIG. 3, more preferably with a vibration damper 30.1 which dampens the deflections in radial direction analogous to the vibration damper 30 of FIG. 2 and which is provided between a cylinder part 31 of the carrying cylinder flange 9 and the bearing housing end wall 49.

Furthermore, FIG. 4 does not show a pressure spring 25 between the screw 26 and the carrying cylinder flange 9, as shown in FIG. 1 to 3, rather it has a vibration damper 33 which is provided between each provided screw 26 and the carrying cylinder flange 9.

This vibration damper has on the one hand the same function as the pressure spring 25 and on the other additionally the function to dampen certain axially directed vibrations.

FIGS. 5 and 6 show an O-ring 30 as radially acting vibration damper instead of the rectangular damper 30 of FIG. 2, however with the same function.

Furthermore, in FIG. 6 the vibration damper 33 shown in FIG. 4 is provided instead of the pressure spring 25, having the above-named functions.

Figure 7:
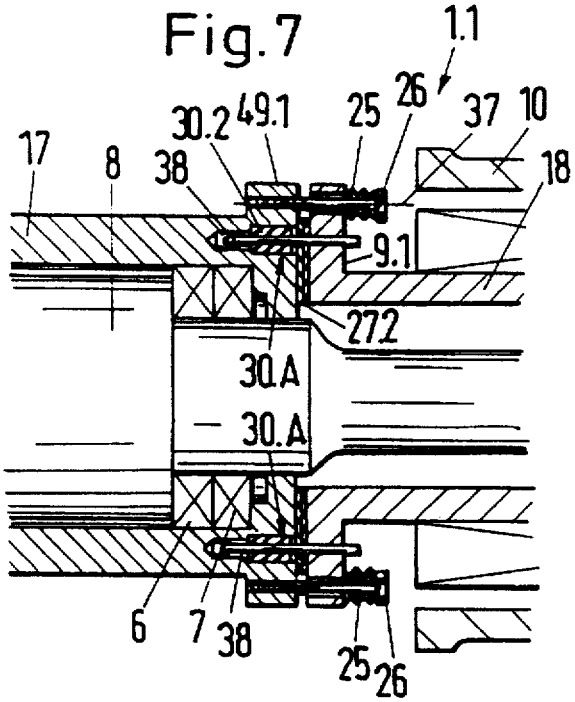
FIG. 7 is a detail in accordance with this invention, of the draw roller unit of FIG. 3.

FIG. 7 shows a spring pin 38 which is permanently embedded with its rear part in the carrying cylinder flange 9.1 and which carries on its front part a radially acting vibration damper 30.2 consisting of a hollow-cylindrical damping element which is inserted in a bore provided in the bearing housing end wall 49.1 of the housing 17. The spring pin 38 and the vibration damper 30.2 form a vibration damper unit 30.A.

Furthermore a ring-shaped vibration damper 27.2, acting in axial direction of the shaft 8 is provided between the bearing housing end wall 49.1 and the carrying cylinder flange 9.1.

By means of the screw 26 and the pressure spring 25 provided on the screw 26 the carrying cylinder flange 9.1 is pressed against the bearing housing end wall 49.1, however only in such a manner that the vibration damper 27.2 can transmit the radial vibrations to the spring pin 38 or to the vibration damper 30.2, i.e., a relative movement between the carrying cylinder flange 9.1 and the bearing housing end wall 49.1 is possible.

As a rule at least three units 30.A composed of the spring pin 38 and the vibration damper 30.2 are evenly distributed circumferentially, here in FIG. 7 the screw 26 is shown directly above this unit, however sensibly being provided between two circumferentially distributed units consisting of spring pin 38 and vibration damper 30.2, which also goes for all circumferentially distributed vibration dampers.

Figure 8:
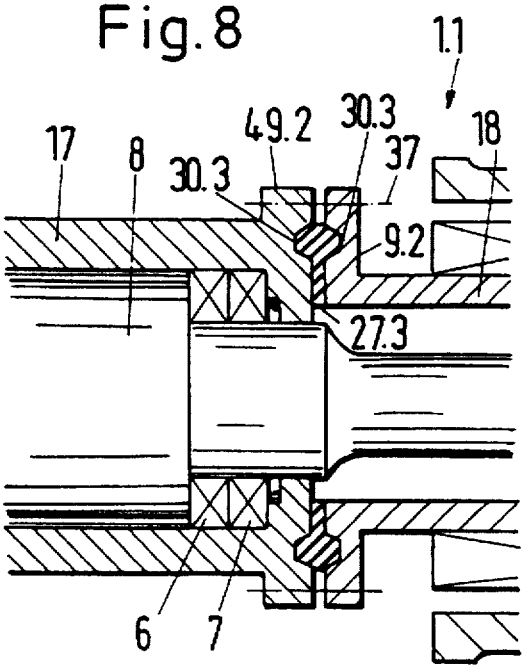
FIG. 8 is a further detail, in accordance of this invention, of the draw roller unit of FIG. 3.

FIG. 8 shows instead of the two-part radial and axial damping means shown in FIG. 7 one damping means consisting of a single ring-shaped element which is composed of on the one hand a radially acting ring-shaped vibration damper 30.3 of basically an octagonal cross section, and on the other of the axially acting ring-shaped vibration damper 27.3. This implies that the vibration, damper 27.3 dampens the axially directed vibrations and the vibration damper 30.3 dampens the radially directed vibrations. Here the octagonal cross section of the vibration damper 30.3 is fitted in ring-shaped grooves (not numbered), here one ring-shaped groove being embedded in the bearing housing end wall 49.2 and the other in the carrying cylinder flange 9.2 of the carrying cylinder 18.

Analogous to FIG. 7, here too the flanges 49.2 and 9.2 are pressed together via screws 26 and springs 25, however, this is only schematically shown in this and in further figures by the center line 37, which is also numbered in FIG. 7.

Figure 8B:
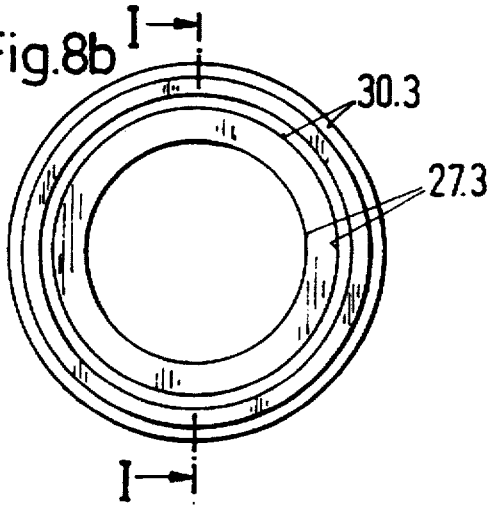
FIG. 8*b* is a detail of FIG. 8*a* looking in direction A at FIG. 8*a;*
Figure 8A:
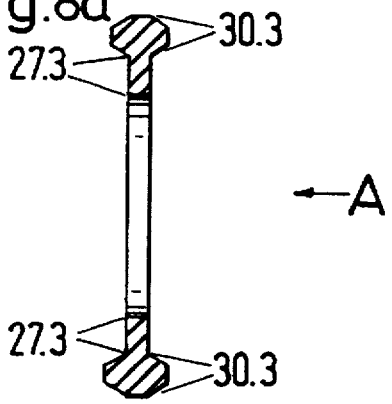
FIG. 8*a* is a detail in accordance with the invention of FIG. 8, shown in a section taken along lines I—I of FIG. 8*b;*

FIG. 8*a* shows separately the vibration damping element shown in FIG. 8, consisting of a ring-shaped vibration damper 27.3, which dampens the axially directed vibrations, and the vibration damper 30.3 connected to its circumference, which dampens the radially directed vibrations. FIG. 8*b* is a plan view of FIG. 8*a* in viewing direction A showing the vibration dampers 27.3 and 30.3.

Figure 9:
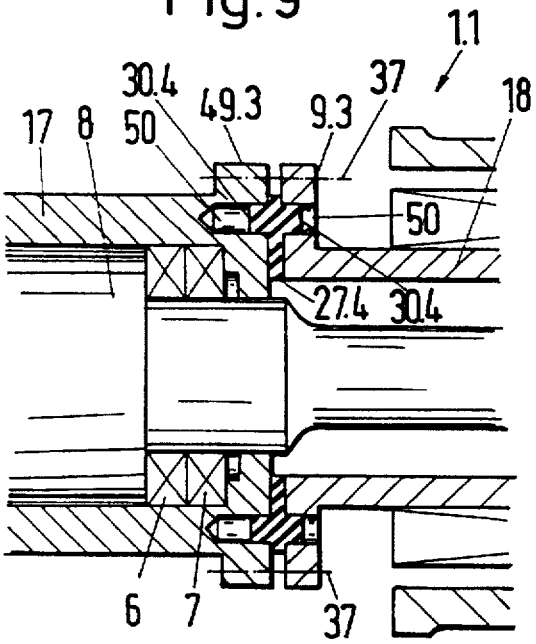
FIG. 9 is a further detail, in accordance of this invention, of the draw roller unit of FIG. 3.

FIG. 9 shows a variant of the radial and axial damping element of FIG. 8 also made of one piece, here however instead of the octagonal radially acting damping element 30.3 there is a vibration damper with opposing cylindrical knobs 30.4 which are arranged evenly distributed around the circumference and opposingly on the ring-shaped vibration damper 27.4. The knobs 30.4 are fitted each in bores 50 of equal diameter which are provided in the bearing housing end wall 49.3 and in the carrying cylinder flange 9.3 depending on the number of knobs 30.4. At least three such knob pairs are evenly provided around the circumference.

Here the knobs 30.4 absorb the radial vibrations and the ring-shaped vibration damper 27.4 absorbs the axial vibrations.

The pressing together of the bearing housing end wall 49.3 and the carrying cylinder flange 9.3 takes place via the screws 26 and the pressure springs 25, hinted at here schematically as an aid with the screw axis 37, however the distribution of these screws around the circumference are as symmetric as the distribution of the knobs 30.4.

Figure 9B:
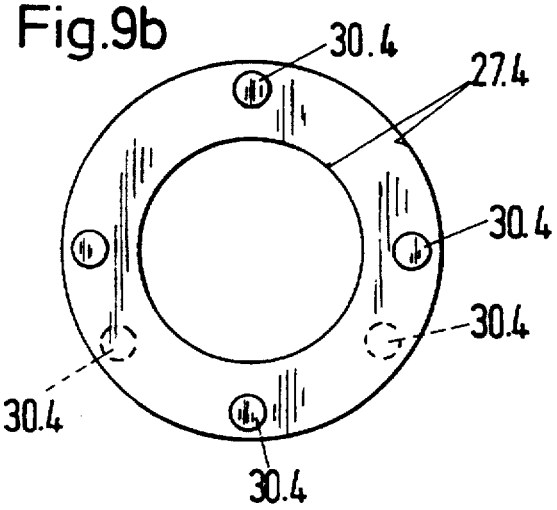
FIG. 9*b* is the detail of FIG. 9*a* looking in direction B at FIG. 9*a;*
Figure 9A:
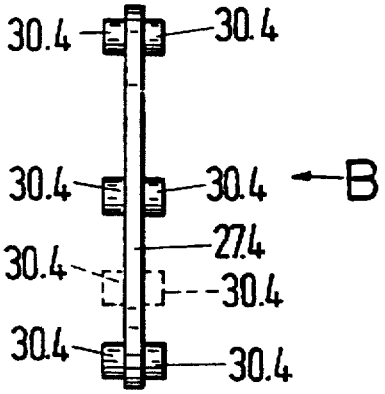
FIG. 9*a* is a side view of the detail of the invention of FIG. 9.

FIG. 9*a* shows separately the vibration dampers according to the invention, i.e., the ring disc with the reference number 27.4 as vibration damper to absorb axially directed vibrations, and the knob-like cylinders with the reference number 30.4 which are vibration dampers to absorb radially directed vibrations. Here the vibration dampers 30.4 are permanently connected with the vibration damper ring 27.4. There exists however also the possibility to simply slide the vibration dampers 30.4 through a bore (not shown) in the vibration damper 27.4, i.e., not to connect them permanently with this ring 27.4. FIG. 9*b* is a plan view of FIG. 9*a* in viewing direction B showing the vibration damper 27.4 and 30.4.

Figure 10:
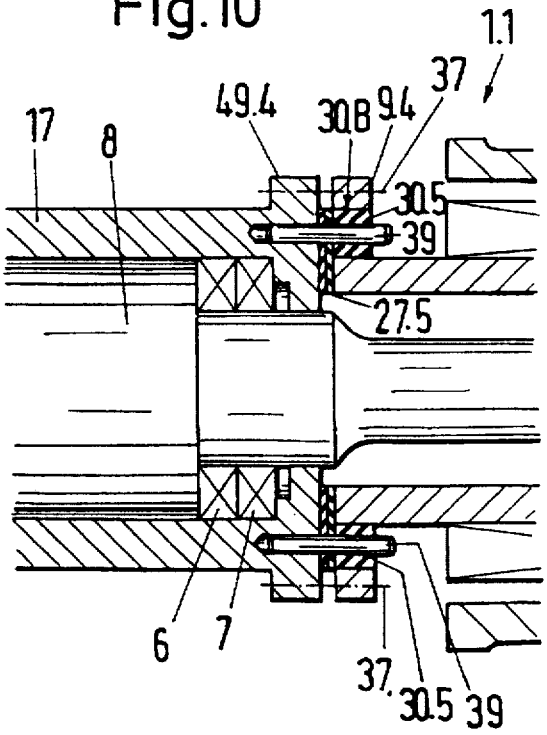
FIG. 10 is a further detail, in accordance of this invention, of the draw roller unit of FIG. 3.

FIG. 10 shows a further variant of the axial and radial vibration damping between a carrying cylinder flange 9.4 and a bearing housing end wall 49.4 in that here the radially acting vibration damper is a hollow cylindrical damping element 30.5, which on the one side is accommodated free from play with its outer cylindrical surface in a bore (not numbered) in the carrying cylinder flange 9.4 of the carrying cylinder 18, and on the other accommodates an end part of a support pin 39 free from play whose other end part is accommodated free from play in the bearing housing end wall 49.4 of the housing 17. The vibration damper 30.5 and the support pin 39 form a vibration damper unit 30.B.

The axial vibrations are absorbed by a ring-shaped vibration damper 27.5, which is held between the bearing housing end wall 49.4 and the carrying cylinder flange 9.4 and is held at a given prestress via the screws 26 and the springs 25. This prestress is of such kind that no play can be formed between the bearing housing end wall 49.4 and the carrying cylinder flange 9.4 and the ring-shaped vibration damper 27.5.

The vibration damper unit 30.B is distributed circumferentially with a given regularity, e.g., evenly in three units.

Figure 11:
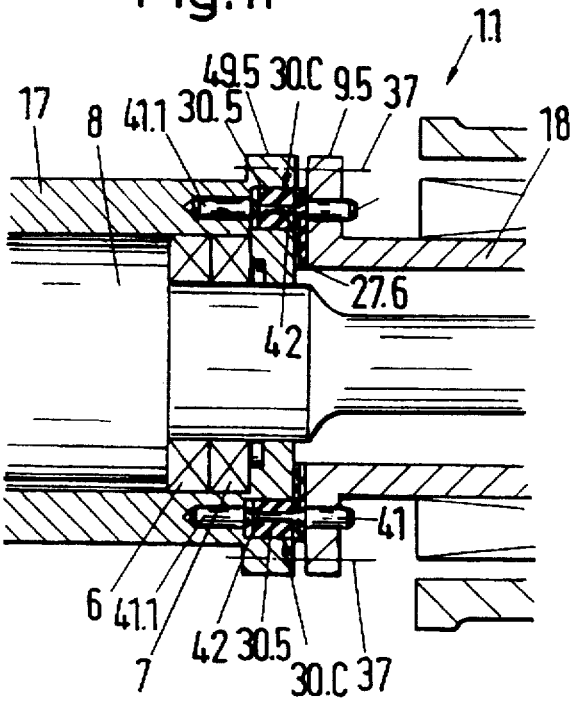
FIG. 11 is a further detail, in accordance of this invention, of the draw roller unit of FIG. 3.

FIG. 11 further shows that the radially acting vibration damper is a hollow-cylindrical damping element 30.5 which is permanently embedded in a bore (not numbered) in the bearing housing end wall 49.5 of the housing 17, and that the damping element 30.5 receives a spring part 42, here at one end of the spring part 42 a support pin 41 is permanently attached which support pin is permanently embedded free from play in the carrying cylinder flange 9.5 of the carrying cylinder 18, and at the other end a support pin 41.1 is permanently attached which is embedded free from play in the housing 17. The support pin 41 and 41.1 and the spring part including the vibration damper 30.5 form a vibration damper unit 30.C.

For the axial damping a ring-shaped vibration damper 27.6 is provided which is provided prestressed between the bearing housing end wall 49.5 and the carrying cylinder flange 9.5 as already with the other ring-shaped vibration dampers. Here the prestress is created by the screw 26 and the springs 25 as described above.

As already described for FIG. 10, these damping elements consisting of elements 41, 41.1, 42 and 30.5 are circumferentially, evenly distributed, here preferably three such units are provided distributed around the circumference, which does not exclude a greater number however. As already mentioned, the screws 26 are distributed circumferentially with a same or a different regularity.

Figure 12:
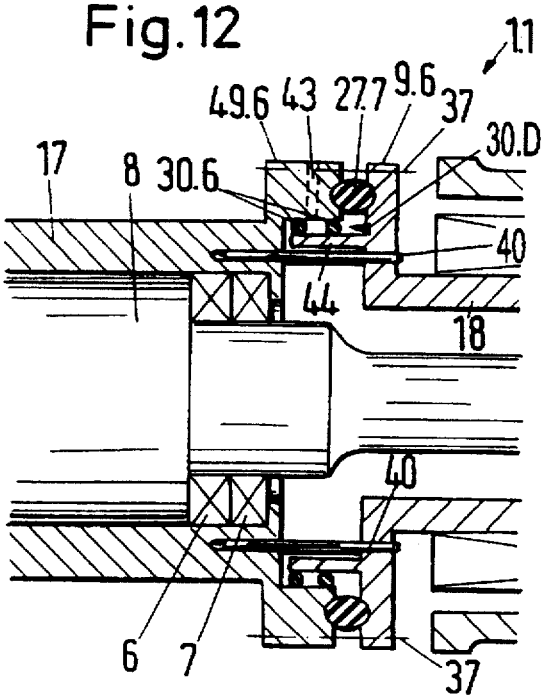
FIG. 12 is a further detail, in accordance of this invention, of the draw roller unit of FIG. 3.

FIG. 12 deviates in relation to said vibration damping in axial and radial direction from the variants shown in FIGS. 7 to 11 in as far as that additionally oil is employed as damping element in that between two O-rings 30.6 via a bore 43 oil is pressed into this space with a given pressure, i.e., free of bubbles, so that said O-rings 30.6 are used on the one hand as sealing elements and on the other are displaced in axial direction by the moved oil up to a minor however unknown measure. The main intent however is the damping by the oil displaced in circumferential direction, which for this has a given viscosity.

The space between the two O-rings 30.6 is limited besides the O-rings themselves by a ring flange 44 as well as by the bearing housing end wall 49.6, the ring flange 44 being part of the carrying cylinder flange 9.6. In FIG. 12 the ring flange 44 is shown in axial direction and parallel thereto a cylindrical inner surface of the bearing housing end wall 49.6, it being merely essential that the ring flange 44 and said cylindrical inner surface are essentially parallel to each other, on the other side an exact axial alignment of these two facing parallel surfaces is not necessary. The two O-rings 30.6 and the spring pin 40 form together with the oil a vibration damping unit 30.D.

The axially directed vibrations are absorbed by an O-ring-shaped vibration damper 27.7 which is provided between the bearing housing end wall 49.6 and the carrying cylinder flange 9.6 with a certain prestress. The prestress is created by the screw 26 and the springs 25, as earlier mentioned, which is schematically replaced by the axis 37.

Here the screws 26 can be provided circumferentially evenly distributed.

Figure 12A:
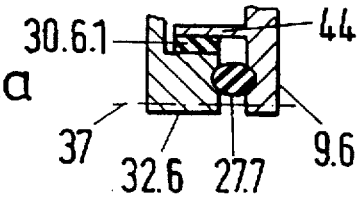
FIG. 12*a* is a variation of a detail of FIG. 12.

FIG. 12*a* shows that instead of the O-rings 30.6 and the oil located inbetween, a full vibration damper 30.6.1 can be provided.

Figure 13A:
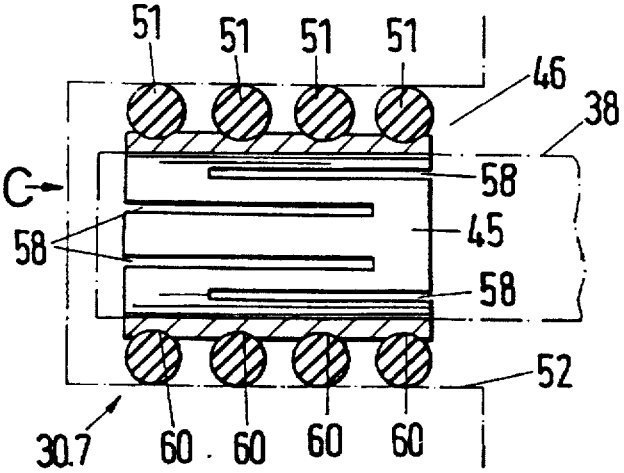
FIG. 13*a* is an enlarged representation of the detail in accordance with the invention of FIG. 13.
Figure 13B:
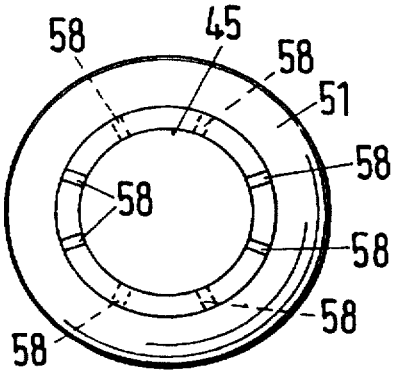
FIG. 13*b* is the detail of FIG. 13*a* looking in direction C at FIG. 13*a;*
Figure 13:
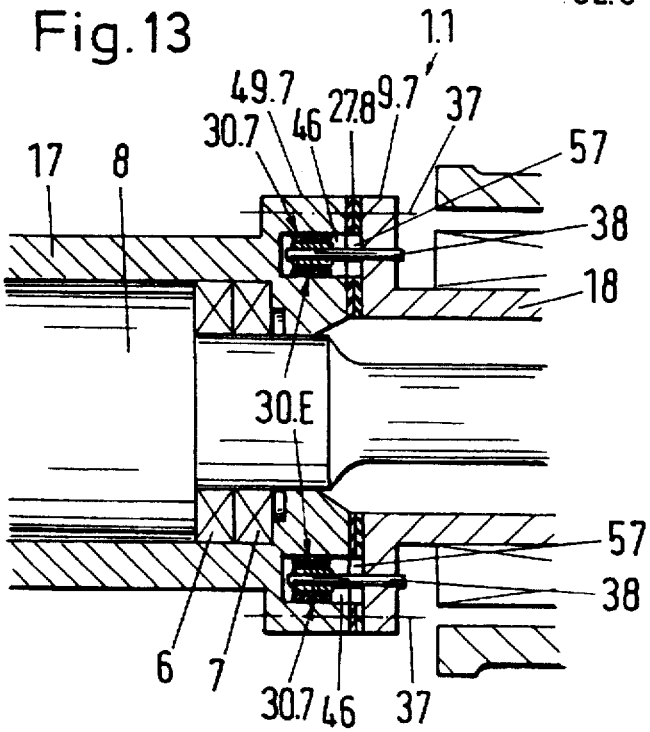
FIG. 13 is a further detail, in accordance of this invention, of the draw roller unit of FIG. 3.

FIG. 13 shows a ring-shaped vibration damper 27.8 to dampen the axially directed vibrations and which is held with a given prestress between the carrying cylinder flange 9.7 and the bearing housing end wall 49.7 as described. The vibration damper 27.8 has a passage 57 for a spring pin 38, which is accommodated on one end in the carrying cylinder flange 9.7 and at the other end carries a slotted sleeve 45 having slots 58, shown enlarged in FIG. 13*a*. This slotted sleeve 45 is embraced by O-rings 51 with such a given prestress that the spring pin 38 receives the slotted sleeve 45 free from play.

Here each O-ring is held in a groove 60 (FIG. 13*a*) which is embedded in the circumference of the slotted sleeve in order not to change its position on the slotted sleeve 45 when the O-rings 51 together with the slotted sleeve 45 are slipped into a cylindrical cavity 46, which is formed by a bore 52 provided in the bearing housing end wall (shown in FIG. 13*a* with line-dotted lines). Here the inner diameter of the bore 52 is such that the inserted O-rings are pressed in radial direction into said grooves 60 and are held in them with a given prestress so that in combination, on the one hand the spring pin 38 is held free from play in the slotted sleeve 45 as described, and on the other that the O-rings are held free from play in the bore 52.

The slotted sleeve 45 and the O-rings form a radially acting vibration damper 30.7 and together with the spring pin they form a vibration damper unit 30.E. At least three such vibration damper units 30.7 are arranged circumferentially distributed, if needed there can be more however.

The advantage of such a vibration damper unit 30.E consists in that the end of the spring pin 38 located in the bearing housing end wall 49.7 can move, however, without even causing any play, because the prestress in the O-rings allows neither a play between the cylindrical bore 52 and the O-rings nor between the spring pin 38 and the slotted sleeve 45.

FIG. 13*b* shows the vibration damper 30.7 in view direction C, and in it the elements with the same functions as in FIG. 13*a* are marked with the same reference numbers.

Figure 14:
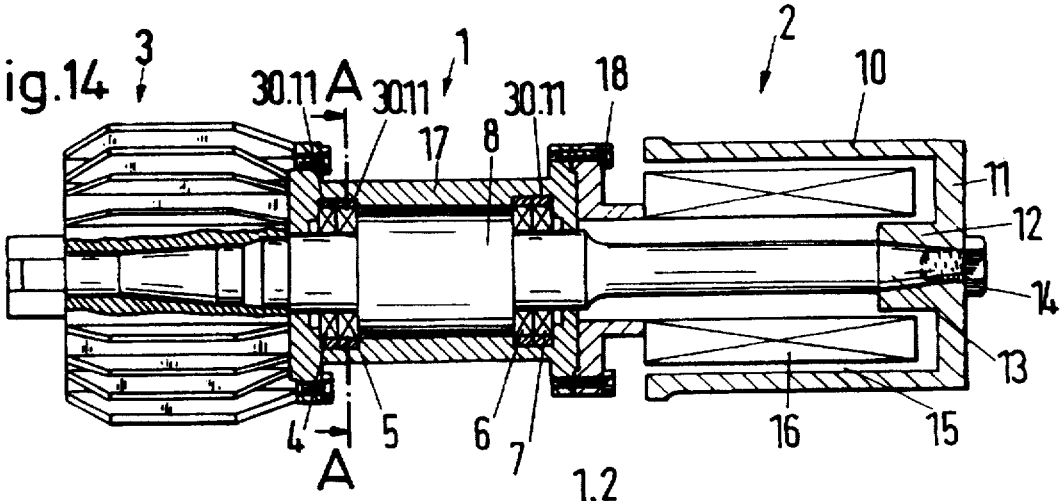
FIG. 14 is a variation of the draw roller unit of FIG. 3.

FIG. 14 provides as variant to FIG. 3 radially acting damper elements 30.11 between the housing 17 and each rolling bearing 4, 5, 6, and 7, in order to dampen the radial movements of the shaft 8 within the housing 17. This FIG. 14 serves as a general basis for the following description of FIGS. 15 and 16.

Figure 15:
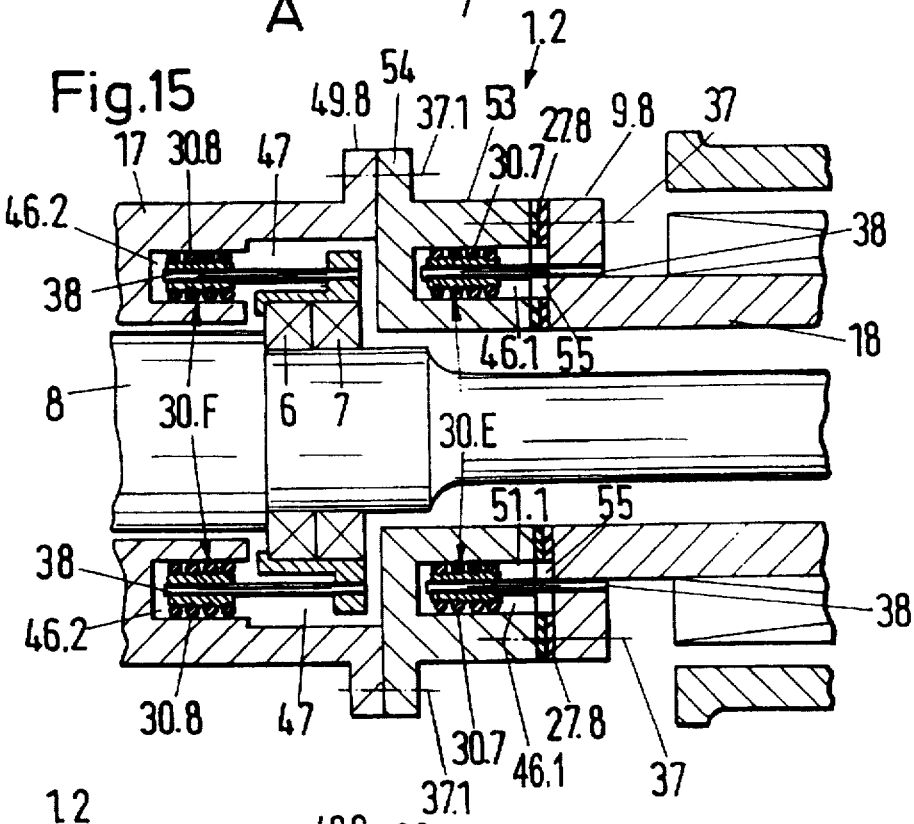
FIG. 15 is an enlargement of the details according to the invention employed in the draw roller unit of FIG. 14.

FIG. 15 shows a combination of the dampened bearing of the carrying cylinder 18 to an adapter 53 as well as of the dampened bearing of the shaft 8 to the bearing housing 17.

Here the adapter 53 is provided between the carrying cylinder flange 9.8 and a bearing housing end wall 49.8 pertaining to the housing 17. The adapter 53 is directed with one end, seen in axial direction of the shaft, towards the carrying cylinder flange 9.8 and lies with the other end, i.e., with the adapter flange 54, on the bearing housing end wall 49.8.

Between the carrying cylinder flange 9.8 and the said end of the adapter 53 directed against it a ring-shaped vibration damper 27.8 is provided which dampens the axial vibrations. The vibration damper 27.8 is provided with bores 55 which are coaxially provided with cavities 46.1, which result each by a bore 51.1 and which have the same diameter as these cavities 46.1.

These cavities 46.1 serve to accommodate one radially acting vibration damper 30.7 known from FIG. 13. Here the cavity 46.1 corresponds to the cavity 46, limited in FIG. 13*a* with dash-dotted lines.

Given that in this Figure it is a radially acting vibration damper unit 30.E, which corresponds to the one for FIG. 13, this vibration damper is numbered in this Figure with 30.7 as well. Furthermore, at least three such vibration damper units 30.E are arranged circumferentially distributed, but there may be more if needed.

According to the drawn screw axis 37 the carrying cylinder flange 9.8 is held together with the adapter 53 via screws 26 and spring elements 25 with such a prestress in the ring-shaped vibration damper 27.8 that the vibration damper 27.8 is capable of absorbing the axial vibrations.

The dampened bearing of the shaft 8 is based on the same principle of vibration damping as provided for the carrying cylinder 18 in that a spring pin 38 of a vibration damper 30.8 is on one side permanently accommodated in a bearing housing 48, which serves for the accommodation of the shaft bearings 6 and 7. The vibration damper unit here is numbered with 30.F.

The spring pin 38 receives at its left end, seen in view on FIG. 15, a slotted sleeve with O-rings 51 which is constructed analogous to FIG. 13*a*.

This combination of slotted sleeve and O-rings also rests in a cavity 46.2 which corresponds in principle to the cavity 46.1. An adapter flange 54 pertaining to the adapter 53 lies directly on the bearing housing end wall 49.8 and is connected to it via screws 26 and spring elements 25, this being shown schematically with the center line 37.1.

Here at least three vibration damping elements 30.7 or 30.8 are to be provided circumferentially in an even distribution, here the screwing connections via the screws 25 must not necessarily be arranged at the same place as the vibration dampers, rather in a given manner inbetween, this also is the case for all screwing connections shown and described in FIGS. 7, 10, 11, 13, or 15, and 16.

Figure 16:
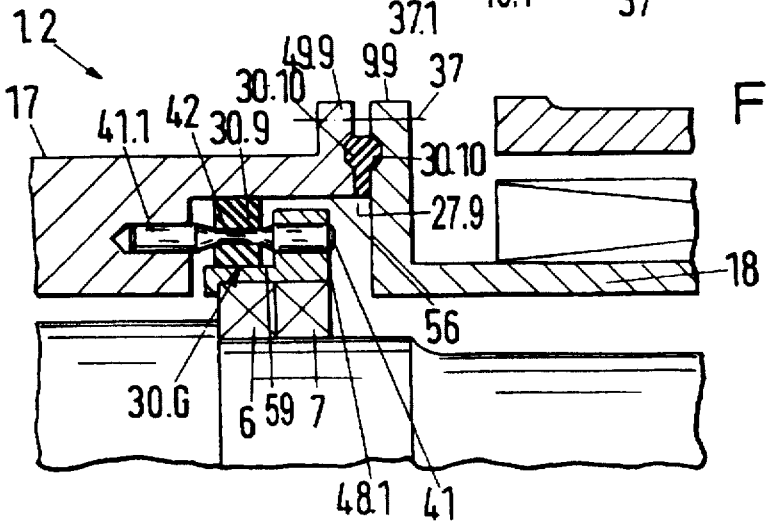
FIG. 16 is a variation in accordance with the invention of FIG. 15, with only the upper half being shown.

FIG. 16 shows a variant of FIG. 15 in that the damping between the carrying cylinder 18 and the bearing housing 17 is effected via an axially acting damping element 27.9, here the damping element 27.9 is arranged between the carrying cylinder flange 9.9 and the bearing housing end wall 49.9, and in principle corresponds to the damper element 27.3 already described for FIG. 8, i.e., that the trapezoid elevations 30.10 are the radially acting vibration dampers between the carrying cylinder flange and the bearing housing end wall.

Furthermore, the radial damping of the bearings 6 and 7 takes place via a radial vibration damper unit 30.C of FIG. 11, here the vibration damper being numbered with 30.9 and the vibration damper unit with 30.G.

Here the bearings 6 and 7 are accommodated in a bearing housing 48.1, and in the bearing housing 48.1 a support pin 41 is permanently arranged whose opposite end 41.1 is accommodated in the housing 17 free from play.

Between the support pin 41 and 41.1 there is a part 42 with a reduced diameter which forms an interacting part together with the support pin 41.1 and 41.2, and here the part 42 receives the radially acting vibration damper 30.9, which on the one hand rests on a cylindrical inner wall 56 of the housing 17 and on the other on the bearing housing part 59 and hence radially dampens the vibrations caused by the shaft.

It should also be mentioned that such a bearing damping can also be provided at the other end of the bearing housing not shown here in a mirror-inverted arrangement for the bearings 4 and 5 (see FIG. 14).

Finally it should be mentioned that no bearing housing is present, as shown in FIG. 1 and 2, rather that the bearing of the shaft takes place directly in the motor casing and that the damping can be effected in the manner as shown in FIGS. 15 and 16 directly in the motor casing. This means that the bearings 20 and 21 of FIG. 1 would be journalled in the manner shown in FIGS. 15 and 16.

Furthermore, the damping types shown in FIGS. 7 to 16 can also be employed with the motor casing 3 shown in FIGS. 1 and 2 as well as 5 and 6.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A draw roller unit for draw winding machines, draw-spinning winding machines and draw twisting machines comprising:

an inductor for heating a godet, a rotatably journalled drive shaft for journalling the godet, a carrying cylinder carrying the inductor a housing for both the attachment of the carrying cylinder and for the retention of bearings for the drive shaft, and at least one vibration damper positioned between the carrying cylinder and the housing for damping of vibrations, created by operation of the draw roller unit, between the carrying cylinder and the housing.

2. The draw roller unit of claim 1, the at least one vibration damper comprising an axial vibration damper, acting in an axial direction.

3. The draw roller unit of claim 2, the axial vibration damper comprising one of a ring-disc shaped damping element and a ring-shaped damping element clamped between the housing and the carrying cylinder.

4. The draw roller unit of claim 3, the radial vibration damper comprising a slotted sleeve attached free from play on one end of a spring pin with the slotted sleeve being provided with grooves for locating O-rings via which the slotted sleeve is pressed together in a manner to be free from play, and the O-rings, including the spring pin, are held in a cylindrical cavity of the housing, an other end of the spring pin being fixedly embedded in the carrying cylinder, and wherein the disc-shaped damping element has passage openings for the passage of the spring pin.

5. The drawing roller unit of claim 1, the at least one vibration damper comprising a radial vibration damper, acting in a radial direction.

6. The draw roller unit of claim 5, the radial vibration damper comprises a hollow-cylindrical damping element, with the damping element resting, on one side, permanently on an end of a spring pin and, on an other side, resting with an outer circumference in a bore of the housing, the bore being free from play, wherein an other end of the spring pin is permanently embedded in the carrying cylinder, and wherein the at least one vibration damper further comprising two additional radial vibration dampers, each radial vibration damper in combination with a spring pin and evenly circumferentially distributed.

7. The draw roller unit of claim 6, the radial vibration damper is provided for the entire damping of the vibrations between the bearings and the housing.

8. The draw roller unit of claim 5, the radial vibration damper comprising a ring, having an octagonal cross section, connected with the axially acting vibration damper, with the ring of octagonal cross section being placed in conforming, opposed ring-shaped grooves in the housing and in the carrying cylinder.

9. The draw roller unit of claim 8, the radial vibration damper is provided for the entire damping of the vibrations between the bearings and the housing.

10. The draw roller unit of claim 5, the radial vibration damper comprising opposing cylindrical knobs which are located oppositely on both sides of the axially acting vibration damper, with at least three pairs of knobs being evenly circumferentially spaced, and wherein each cylindrical knob is fitted in a bore of a similar diameter, located in the housing and in the carrying cylinder.

11. The draw roller unit of claim 10, the radial vibration damper is provided for the entire damping of the vibrations between the bearings and the housing.

12. The draw roller unit of claim 5, the radial vibration damper comprises a hollow-cylindrical damping element permanently embedded in a bore in the carrying cylinder, and receiving one end part of a support pin with the support pin being free from play, and an other end of the support pin being fixedly embedded in the housing, the at least one vibration damper comprising two additional radial vibration dampers, each radial vibration damper in combination with a support pin and evenly circumferentially spaced.

13. The draw roller unit of claim 12, the radial vibration damper is provided for the entire damping of the vibrations between the bearings and the housing.

14. The draw roller unit of claim 5, the radial vibration damper comprises a hollow cylindrical damping element, the damping element being permanently embedded in a bore of the housing, and wherein the damping element receives a spring part, one end of the spring part being fixedly attached to a support pin which is fixedly embedded in the carrying cylinder, and at an other end of the spring part a support pin is fixedly attached, with the support pin being fixedly embedded in the housing, the at least one vibration damper comprising two additional radial vibration dampers, each radial vibration damper in combination with a support pin and evenly circumferentially distributed.

15. The draw roller unit of claim 14, the radial vibration damper is provided for the entire damping of the vibrations between the bearings and the housing.

16. The draw roller unit of claim 5, the radial vibration damper comprises two rubber O-rings, the O-rings being clamped, at a mutual distance, between a ring flange of the carrying cylinder and a cylindrical inner surface opposite thereto and wherein a space between the O-rings is filled with one of a fluid and a fully elastic damping element wherein at least three spring pins are fixedly and evenly circumferentially distributed outside of the space in the carrying cylinder and in the housing.

17. The draw roller unit of claim 16, the radial vibration damper is provided for the entire damping of the vibrations between the bearings and the housing.

18. The draw roller unit of claim 5, the radial vibration damper comprising a slotted sleeve attached free from play on one end of a spring pin, the slotted sleeve being provided with grooves for locating O-rings via which the slotted sleeve is pressed together in a manner to be free from play, and the O-rings, including the spring pin, are held in a cylindrical cavity of the housing, an other end of the spring pin being fixedly embedded in the carrying cylinder, and wherein the disc-shaped damping element has passage openings for the passage of the spring pin.

19. The draw roller unit of claim 18, the radial vibration damper is provided for the entire damping of the vibrations between the bearings and the housing.

20. The draw roller unit of claim 1, the at least one vibration damper comprising an axial and a radial vibration damper.

21. The draw roller unit of claim 20, the radial vibration damper comprising a ring, having an octagonal cross section, connected with the axial vibration damper, the ring of octagonal cross section being placed in conforming, opposed ring-shaped grooves in the housing and in the carrying cylinder.

22. The draw roller unit of claim 21, the radial vibration damper is provided for the entire damping of the vibrations between the bearings and the housing.

23. The draw roller unit of claim 20, the radial vibration damper comprising opposing cylindrical knobs which are located oppositely on both sides of the axial vibration damper, with at least three pairs of knobs being evenly circumferentially spaced, and wherein each cylindrical knob is fitted in a bore of a similar diameter, located in the housing and in the carrying cylinder.

24. The draw roller unit of claim 23, the radial vibration damper is provided for the entire damping of the vibrations between the bearings and the housing.

25. The draw roller unit of claim 1, the at least one vibration damper further comprising a radial vibration damper comprising a slotted sleeve which is attached free from play on one end of a spring pin with the slotted sleeve being provided with grooves for locating O-rings via which the slotted sleeve is pressed together in a manner to be free from play, and the O-rings, including the spring pin, are held in a cylindrical cavity of the housing, an other end of the spring pin being fixedly embedded in the carrying cylinder, and wherein the disc-shaped damping element has passage openings for the passage of the spring pin, with the radial vibration damper being provided for damping the vibrations between the drive shaft and the inductor.

26. The draw roller unit of claim 1, the at least one vibration damper comprising a radial vibration damper, comprising a hollow cylindrical damping element, with the damping element being permanently embedded in a bore of the housing, and wherein the damping element receives a spring part, with one end of the spring part being fixedly attached to a support pin which is fixedly embedded in the carrying cylinder, and at an other end of the spring part a support pin is fixedly attached, with the support pin being fixedly embedded in the housing, the at least one vibration damper comprising two additional radial vibration dampers, each radial vibration damper in combination with said support pin and evenly circumferentially distributed, with the radial vibration dampers provided for damping vibrations between the shaft bearings and the housing.

27. The draw roller unit of claim 1, further comprising at least one elastic element is provided between an attachment means for attaching the inductor to the housing and the inductor.

28. The draw roller unit of claim 27, the elastic element comprising a pressure spring.

29. The draw roller unit of claim 27, the elastic element comprising another vibration damper.

30. The draw roller unit of claim 1, the at least one vibration damper further comprising at least one radial vibration damper operating in combination with the axial vibration damper and positioned between the bearings and the housing.

* * * * *